US005790926A

United States Patent [19]

Mizoe et al.

[11] Patent Number: 5,790,926

[45] Date of Patent: Aug. 4, 1998

[54] CHARGING MEMBER HAVING A RAISED FIBER-ENTANGLED MATERIAL, AND PROCESS CARTRIDGE AND ELECTROPHOTOGRAPHIC APPARATUS HAVING THE CHARGING MEMBER

[75] Inventors: Kiyoshi Mizoe, Kawasaki; Shuichi Aita; Fumihiro Arahira, both of Yokohama; Yoshifumi Hano, Inagi, all of Japan

[73] Assignee: Canon Kabushiki Kaisha, Tokyo, Japan

[21] Appl. No.: 623,187

[22] Filed: Mar. 28, 1996

[30] Foreign Application Priority Data

Mar. 30, 1995 [JP] Japan ..... 7-072835
Jul. 31, 1995 [JP] Japan ..... 7-194514

[51] Int. Cl.[6] ..... G03G 15/02

[52] U.S. Cl. ..... 399/174; 361/221; 399/175; 399/176; 492/50

[58] Field of Search ..... 399/174–176; 492/50; 361/220, 221, 225

[56] References Cited

U.S. PATENT DOCUMENTS

| | | | |
|---|---|---|---|
| 4,371,252 | 2/1983 | Uchida et al. | 399/175 |
| 4,476,186 | 10/1984 | Kato et al. | 428/290 |
| 4,706,320 | 11/1987 | Swift | 15/1.5 R |
| 5,060,016 | 10/1991 | Wanou et al. | 399/175 |
| 5,245,386 | 9/1993 | Asano et al. | 399/175 |
| 5,576,807 | 11/1996 | Osawa et al. | 399/175 |

FOREIGN PATENT DOCUMENTS

| | | |
|---|---|---|
| 0576203 | 12/1993 | European Pat. Off. . |
| 0615177 | 9/1994 | European Pat. Off. . |
| 56-126862 | 10/1981 | Japan . |
| 61-47970 | 3/1986 | Japan . |
| 62-274009 | 11/1987 | Japan . |
| 63-149669 | 6/1988 | Japan . |
| 6-274009 | 9/1994 | Japan . |

OTHER PUBLICATIONS

European Search Report.

*Primary Examiner*—William J. Royer
*Attorney, Agent, or Firm*—Fitzpatrick, Cella, Harper & Scinto

[57] ABSTRACT

A charging member includes a conductive substrate and a surface layer which is to be brought into contact with a member to be charged. On the surface layer a raised fiber entangled material is provided.

19 Claims, 2 Drawing Sheets

CHARGING MEMBER HAVING A RAISED FIBER-ENTANGLED MATERIAL, AND PROCESS CARTRIDGE AND ELECTROPHOTOGRAPHIC APPARATUS HAVING THE CHARGING MEMBER

BACKGROUND OF THE INVENTION

1. Field of the Invention

This invention relates to a charging member used in image formation. More particularly, this invention relates to a contact charging member which is brought into contact with a charge-receiving member (which is to be electrified) and to which a voltage is applied to uniformly charge the charge-receiving member.

This invention also relates to a process cartridge and an electrophotographic apparatus which have such a charging member.

2. Description of the Related Art

As assemblies for charging charge-receiving members such as electrophotographic photosensitive members, corona charging assemblies and contact charging assemblies are employed in image forming apparatuses such as the electrophotographic apparatus.

The contact charging assemblies are devices with which the charge-receiving member is charged by applying a DC voltage or an oscillating voltage in which an AC voltage is superimposed on a DC voltage, to a charging member brought into contact with the charge-receiving member.

In such contact charging assemblies, as disclosed in Japanese Patent Application Laid-Open No. 63-149669 (149669/1985), an oscillating electric field having a peak-to-peak voltage which is at least twice the voltage applied at the initial charging of the charge-receiving member is formed between the contact charging member and the charge-receiving member when a DC voltage is applied to the contact charging member, whereby the charge-receiving member can be charged.

An example of the constitution of the contact charging member will be shown below.

FIG. 5 is a vertical cross-sectional view of a charging roller serving as the charging member. A charging roller 10 is constituted of a conductive substrate 11 serving as a support member (a mandrel), a conductive elastic layer 13 having elasticity enough to form a uniform nip with respect to the surface of the charge-receiving member, and a medium-resistance charging layer 12 that controls the resistance of the charging roller 10.

The conductive elastic layer 13 is a conductor formed of a solid rubber such as acrylic rubber, urethane rubber or silicone rubber in which a conductive filler such as metal oxide or carbon black has been dispersed.

The charging layer 12 is commonly formed of a medium-resistance member, and is so constituted that no faulty charging may occur in image areas even if any imperfections such as pinholes are produced in the charge-receiving member. The charging layer provided as a medium-resistance member is formed by coating the surface of the conductive elastic layer with a dispersion prepared by dispersing a conductive filler such as metal oxide or carbon black in a resin such as acrylic resin, nylon, polyester, polyurethane, phenol resin or styrene resin, using dip coating, spray coating, roller transfer coating or the like.

To illustrate an image forming apparatus having the contact charging roller as described above, an example of the constitution of a laser beam printer employing a reverse development system will be shown below.

FIG. 6 illustrates the structure of a contact charging assembly 20. The charging roller 10 is provided substantially in parallel to a photosensitive member 21 serving as the charge-receiving member, and is brought into pressure contact with the photosensitive member at a given contact nip width. Here, the pressure contact is effected by pressure springs 22 positioned at both ends of the conductive substrate of the charging roller. In the state of this pressure contact, the charging roller is rotated following the rotation of the photosensitive member rotating at a stated process speed, to successively charge the surface of the photosensitive member. In the drawing, reference numeral 23 denotes a power source.

FIG. 7 schematically illustrates a laser beam printer provided with a process cartridge 37 having the contact charging member described above. The photosensitive member 21 charged by the contact charging member 10 is scanning-exposed to laser light 31, so that an electrostatic latent image is formed on the surface of the photosensitive member. The electrostatic latent image is developed to a toner image by means of a developing assembly 32 (reverse development), and the toner image is transferred to a transfer medium 34 fed to the area where a transfer assembly 33 is in pressure contact with the photosensitive member. Here, the toner remaining on the photosensitive member after transfer is removed by a cleaning assembly 35, and the photosensitive member is made ready for the subsequent image formation. The transfer medium to which the toner image has been transferred is transported to a fixing assembly 36, where the toner image is fixed, and thereafter outputted to the outside as a copy. The electrophotographic photosensitive member 21, the contact charging member 10, the developing assembly 32 and the cleaning assembly 35 are integrally supported as a process cartridge so that it is detachable from the body of the printer by the use of a guide means such as rails 38.

Now, when the contact charging member having the charging layer formed of the resin and the conductive filler as described above is used over a long period of time, it may wear down the photosensitive member to cause lowering of charging performance.

The rotation of the contact charging member in pressure contact is pointed out as one of the causes of such wear. In the contact charging, however, in order to achieve a satisfactory charging performance, it is required to bring the charging member into uniform contact with the photosensitive member, and hence a certain degree of pressure of the charging member against the photosensitive member is regarded as necessary and unavoidable means.

The above contact charging member may undergo changes in surface resistance if transfer residual toner, photosensitive member scrapings and the like have adhered to its surface, resulting in lowering of charging performance.

U.S. Pat. No. 4,371,252 and Japanese Patent Application Laid-Open No. 6-274009 (274009/1994) disclose charging members comprising conductive fibers. The former charging member is constituted of a substrate, an elastic layer, an electrode layer and a contact layer, and the contact layer, which is in contact with the photosensitive member to carry out charging, is formed of a conductive fibrous aggregate. The latter comprises a conductive holder, an elastic core material and a conductive nonwoven fabric coming in contact with the photosensitive member. Fibrous members may cause less wear of the photosensitive member than the resin layers, and are expected to prevent the surface scrape.

However, fibers just having been prepared by spinning are poor in contact performance with the charge-receiving member and satisfactory charging performance often cannot be achieved. Accordingly, under existing circumstances, in the contact charging member using fibrous members, the pressure of contact with the charge-receiving member is made higher or the contact area (i.e., the nip) is made broader to prevent the charging performance from lowering. Hence, it has been difficult to prevent the surface scrape of the photosensitive member over a long period of time. Also, because of an insufficient contact performance with the photosensitive member, the charging performance may lower if the transfer residual toner has adhered to the fibrous member. Such a disadvantage has been also pointed out.

For the purpose of preventing the surface scrape of the photosensitive member, another charging member is also proposed which employs an elastic layer formed of a low-hardness rubber or foam that can achieve sufficient contact even at a low pressure contact force. Since the elastic layer has been made lower in hardness, the photosensitive members are directed to less scraping. However, because of the effect of friction acting between the charging layer formed of a resin layer and the photosensitive member, the scrape has not been fundamentally prevented.

Meanwhile, contact charging is roughly grouped into usual charging that utilizes discharge, and the injection charging that directly injects charges from a charging member into a charge injection layer provided as a surface layer of a photosensitive member, as disclosed in EP-A 576203 and EP-A 615177. The injection charging does not utilize discharge, and hence is very advantageous in view of making the applied voltage lower and preventing ozone from being generated.

However, in the case of the injection charging, electric charges are injected only at the contact point between the charging member and the injection point of the charge injection layer, and hence, as compared with the case of usual contact charging, the contact performance of the charging member has greater effect upon charging performance. Thus, in the case of the injection charging, the conventional charging member whose surface is formed by the above resin layer or usual brush contactor more remarkably tends to cause the problem of lowering of charging performance due to the difficulty in obtaining sufficient contact performance.

OBJECTS OF THE INVENTION

An object of the present invention is to provide a charging member having a superior contact performance with a charge-receiving member.

Another object of the present invention is to provide a charging member that may hardly scrape the surface of a charge-receiving member.

Still another object of the present invention is to provide a charging member capable of uniformly charging a charge-receiving member even when repeatedly used.

A further object of the present invention is to provide a process cartridge and an electrophotographic photosensitive member which have the above charging member.

SUMMARY OF THE INVENTION

It has been found that the foregoing objectives can be realized by providing a charging member which is to be provided in contact with a charge-receiving member (a member to be charged) and to which a voltage is to be applied to charge the charge-receiving member, the charging member comprising a conductive substrate and a surface layer which is to come in contact with the charge-receiving member, the surface layer having a raised fiber entangled material.

The present invention also provides a process cartridge and an electrophotographic photosensitive member, having the above charging member.

BRIEF DESCRIPTION OF THE INVENTION

DESCRIPTION OF THE PREFERRED EMBODIMENTS

Figure 1:
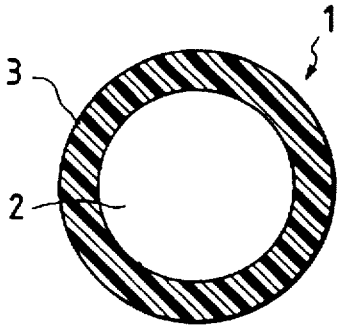
FIG. 1 is a cross section of a charging roller according to the present invention.

The charging member of the present invention is provided in contact with a charge-receiving member (the member to be charged) and to which a voltage is applied to charge the charge-receiving member, where it has a conductive substrate and a surface layer which comes in contact with the charge-receiving member, and the surface layer has a raised fiber entangled material.

The fiber entangled material used in the present invention may be any material so long as the fibers have been raised, and either woven fabric or nonwoven fabric may be used.

Methods for raising the fabric may include buffing, which is a treatment using sand paper, and brushing, which is a treatment using a rigid brush. In the present invention, the raising of the fiber entangled material brings about an increase in the contact area with the photosensitive member, and hence the charging can be made uniform under conditions of a lower contact pressure. Moreover, the raised fabric entangled material have sharp fiber tips, and hence the charging performance can be dramatically improved.

Fibers used in the present invention include synthetic fibers, natural fibers, semisynthetic fibers and regenerated fibers. As examples thereof, the synthetic fibers include polyamides such as nylon 6, nylon 66, nylon 12, nylon 46 and aramid types, polyesters such as polyethylene terephthalate (PET), polyolefins such as polyethylene (PE) and polypropylene (PP), polyvinyl alcohol types, polyvinyl or polyvinylidene chloride types, polyacrylonitrile types, polyphenylene sulfide, polyurethane, polyfluoroethylene, carbon fiber and glass fiber. The natural fibers include, for example, silk, cotton, wool and hemp. The semisynthetic fibers include acetates, and the regenerated fibers include rayon and cuprammonium rayon. Conjugate fibers may also be used which are obtained by combining two or more material components of synthetic fibers followed by melt spinning. These fibers may be used alone or in combination of two or more kinds.

In the present invention, it is preferable to use ultrafine-fiber generation type conjugate fibers. The reason is that such fibers enable the fabric to be raised in a high density with ease, and also the fiber entangled material constituted of such ultrafine fibers can have a high strength and have a superior durability when used in charging members, so that more uniform charging can be obtained over a long period of time. Thus, the present invention is remarkably effective especially when applied in injection charging. Such ultrafine-fiber generation type conjugate fibers may be used alone or in combination of two or more kinds. They may also be used in combination with the fibers described above.

The ultrafine-fiber generation type conjugate fibers may preferably include etching fibers and split fibers.

The etching fibers used in the present invention refer to fibers obtained by chemically removing only specific components from a plurality of components by the use of an acid or alkali, and may include synthetic fibers, natural fibers, semisynthetic fibers and regenerated fibers.

In the present invention, conjugate fibers are used which are obtained by conjugate-spinning at least two kinds of materials selected from among starting materials for the above fibers. Chemically etchable conjugate fibers include core-sheath fibers, which can provide single ultrafine fibers, and sea-island (islands-in-a-sea type) fibers, which can provide a plurality of ultrafine fibers. These conjugate fibers are fibers obtained by conjugate-spinning, e.g., a polyester type hydrolyzable resin and a polyamide type, polyolefin type or polyacrylic type non-hydrolyzable resin, where fibers comprised of non-hydrolyzable resin can be obtained by hydrolysis with an acid or alkali. The hydrolyzable resin may also include conjugate fibers of a solvent-soluble resin and a non-soluble resin.

For example, in the case of the sea-island fibers, PET as the hydrolyzable resin is used in the sea and nylon 6 as the non-hydrolyzable resin is used in the island present in plurality, and hydrolysis is carried out using an aqueous solution of alkaline, sodium hydroxide or potassium hydroxide, so that the sea PET component is decomposed and removed and the island nylon 6 components in plurality are obtained as ultrafine fibers.

As for the split fibers used in the present invention, they refer to fibers obtained by splitting a material by utilizing a difference in the rate of heat shrinkage or an external force, and may include the synthetic fibers, natural fibers, semisynthetic fibers and regenerated fibers as described above.

Specifically, incompatible thermoplastic resins are conjugate spun, and the product is subjected to stretching and heat treatment. Upon heating, it is opened and split due to differences in shrinkage at the respective portions. Here, the incompatible thermoplastic resins may be in such combination that, for example, one is polyester and the other is nylon, polypropylene or the like.

Alternatively, the fibers are opened and split into groups of ultrafine fibers by high-pressure water jetting or needle punching. In this case, the above ultrafine-fiber generation type conjugate fibers produced by utilizing difference in the rate of heat shrinkage may be used so that the fibers can be more efficiently opened and split. Here, the incompatible thermoplastic resins may be in such combination that, for example, one is polyester and the other is nylon, polypropylene or the like.

The etching fibers and split fibers have fine irregularities on the fiber surfaces, and hence they have a very high performance of coming in contact with the charge-receiving member and can provide uniform charging. They can be effective especially when applied to the injection charging.

In the present invention, there are no particular limitations on the number of ultrafine fibers (number of segments) and fineness of ultrafine fibers produced from the ultrafine-fiber generation type conjugate fibers. Taking account of long-term fiber durability, the number of segments may preferably be from 1 to 100, and an average fiber diameter, from 0.05 μm to 30 μm. The average fiber diameter is a value obtained in the following way: At 10 spots picked up at random on an electron microscope photograph, the diameters of ten fibers per spot are measured, and the measurements obtained at each spot are averaged.

In the present invention, the charging layer may preferably have a fiber resistance R of $1\times10^3\Omega \leqq R \leqq 10^9\Omega$. If the resistance R is made smaller than $1\times10^3\Omega$, leak may occur when pinholes are present in the photosensitive member, resulting in faulty charging in such an instance. If the resistance R is made larger than $1\times10^9\Omega$, it becomes difficult to achieve uniform charging.

Here, the resistance R is the value calculated from current values measured when the charging layer is brought into touch with a conductive metal rotator and a DC voltage of 100 V is applied.

As methods for making fibers conductive, they may include, for example;

1) a method in which conductive fibers are used which are prepared by spinning a fiber material having a conductive filler dispersed therein;

2) a method in which a conductive electron-conjugate polymer (hereinafter referred to as "conductive polymer") is imparted to fiber surfaces; and 3) a method in which a binder resin with a conductive filler dispersed therein is imparted to fiber surfaces. In particular, it is preferable to use the conductive polymer as in the method-2). The conductive polymer may be used alone, or may be used in combination in the method-1) and/or the method-3).

In the method-1), the conductive fibers may be used alone, may be mixed and entangled with fibers not subjected to conductive treatment to make the entangled material conductive.

Preferred examples of the above conductive polymer may include polypyrrol, polythiophene, polyquinoline, polyphenylene, polynaphthylene, polyacetylene, polyphenylene sulfide, polyaniline, polyphenylene vinylene, and polymers of derivatives of monomer components thereof. Any of these may be used alone or in combination of two or more kinds.

Preferred examples of the binder resin may include olefin resins, acrylic resins, polyurethane resins, phenol resins, nylon resins, and polyester resins. Preferred examples of the conductive filler may include powders or fibers of metals such as aluminum, tin, iron and copper, metal oxides such as zinc oxide, tin oxide and titanium oxide, metal sulfides such as copper sulfide and zinc sulfide, and carbon powders such as carbon black.

The conductive agents as described above may be applied on the fibers by solution coating or gaseous phase coating. For example, in the case of a solution of the conductive polymer dissolved in a solvent, or a binder resin solution with the conductive filler dispersed therein, the fibers may be impregnated with the solution, or the solution may be imparted to the fibers by a means such as spray coating or roller coating. Alternatively, monomers as precursors of the conductive polymer may be brought into contact with fibers having been subjected to catalytic treatment, whereby the fiber surfaces can be coated with the conductive polymer. Here, the monomers may be brought into contact in the form of either vapor or liquid.

In the present invention, as manners of effecting the conductive treatment of fibers, fibers obtained right after spinning may be made conductive, or fibers having been worked into the fiber entangled material may be made conductive.

Materials for the conductive substrate may include metals or alloys such as aluminum and aluminum alloys, and resins in which conductive carbon black or conductive particles of metals or conductive metal oxides have been dispersed. The substrate may have the shape of a rod or the shape of a blade such as a flat plate or an inverse V-shaped plate.

In the present invention, a conductive elastic layer may be provided between a fabric base having the fiber entangled material and the conductive substrate. As elastic materials used, they may include, for example, synthetic rubbers such as EPDM, NBR, butyl rubber, acrylic rubber, urethane rubber, polybutadiene, butadiene-styrene rubber, butadiene-acrylonitrile rubber, polychloroprene, polyisoprene, chlorosulfonated polyethylene, polyisobutyrene, isobutyrene-isoprene rubber, fluorine rubber and silicone rubber, and natural rubbers. These elastic materials may be optionally foamed by using a foaming agent or the like to form cells having appropriate cell diameters. The elastic materials can be readily made conductive using a conductive filler. Such a conductive filler may include, for example, powders or fibers of metals such as aluminum, nickel, stainless steel, palladium, zinc, iron, copper and silver, composite metal powders of any of zinc oxide, tin oxide, titanium oxide, copper sulfide and zinc sulfide, and carbon powders such as acetylene black, ketchen black, PAN type carbon and pitch type carbon. Any of these may be used alone or in combination of two or more kinds.

As the form of the charging member having the brush contactor according to the present invention, it may have the shape of, for example, a roller, a blade or a belt. In particular, the shape of a roller or a belt is preferred. Examples of the constitution of the charging member will be given below.

Figure 2:
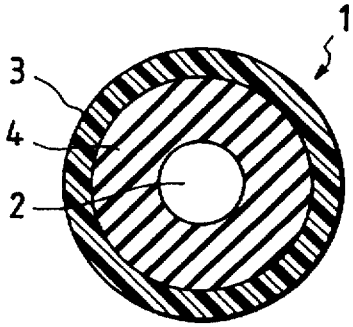
FIG. 2 is a cross section of a charging roller according to the present invention, having a conductive elastic layer.

FIG. 1 illustrates a charging roller 1. This is constituted of a conductive substrate 2 (a mandrel) and a raised fiber entangled material 3 wound around it. As a manner of winding the latter around the former, for example, a narrow fiber entangled material may be wound in a spiral, or a broad fiber entangled material with a width corresponding to the length of the charging member may be stuck on the mandrel. FIG. 2 shows an example in which the conductive elastic layer 4 is provided between the conductive substrate 2 and a surface layer 3.

Figure 3:
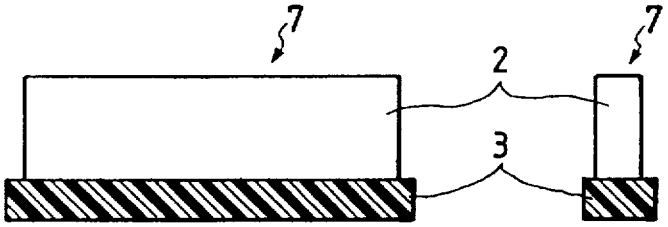
FIG. 3 is a front view and side view of a charging blade according to the present invention.

FIG. 3 illustrates a charging blade 7, which is composed of a blade-like conductive substrate 2 and the raised fiber entangled material 3 stuck thereon. The blade may be connected with a vibrator (not shown), thereby vibration-moving before and behind as well as left and right on the surface of the photosensitive member.

Figure 4:
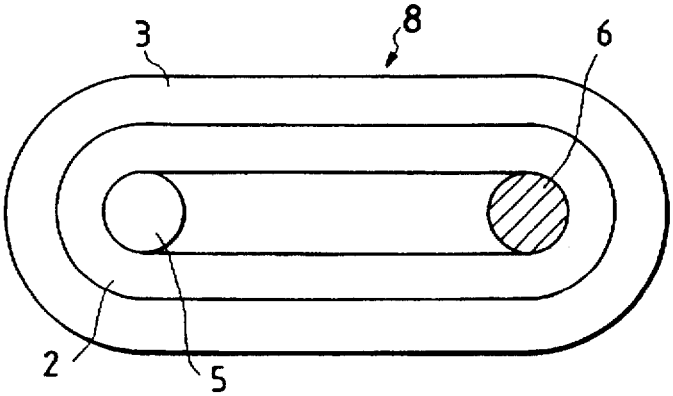
FIG. 4 is a cross section of a charging belt according to the present invention.
Figure 5:
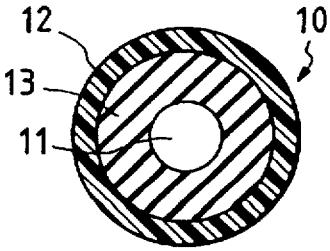
FIG. 5 PRIOR ART
FIG. 5 is a cross section of a conventional charging roller.
Figure 6:
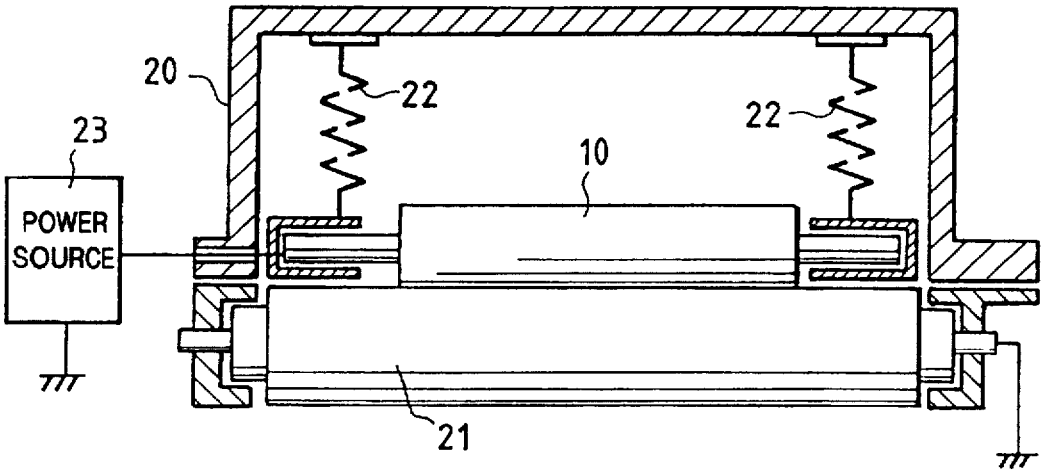
FIG. 6 is a front view of a contact charging assembly.

FIG. 4 illustrates a belt-like charging member 8. Reference numeral 3 denotes the raised fiber entangled material; and 2, a conductive substrate comprised of a conductive rubber, which is fixed and rotated by a drive roll 6 and a follower roll 5. Besides the double-shaft type fixed belt as shown in FIG. 4, a three-shaft type fixed belt or more-shaft type fixed belt may be employed in which the roll at the position of the drive roll shown in FIG. 4 is replaced with a follower roll and a drive roll or rolls is/are anew provided.

The photosensitive member serving as the charge-receiving member used in the present invention may be of any type, which may have at least a photosensitive layer on a conductive support, and may be optionally provided with a protective layer or a charge injection layer on the photosensitive layer.

The charge injection layer may preferably be adjusted to have a volume resistivity within the range of from $1\times10^{8}\Omega\cdot$cm to $1\times10^{15}\Omega\cdot$cm in order to satisfy the condition that a sufficient charging performance can be obtained and no smeared images may occur. In particular, from the viewpoint of preventing smeared images, it may preferably have a volume resistivity of from $1\times10^{10}\Omega\cdot$cm to $1\times10^{15}\Omega\cdot$cm, and more preferably from $1\times10^{12}\Omega\cdot$cm to $1\times10^{15}\Omega\cdot$cm so as to cause neither smeared images nor faulty charging even under abrupt environmental variations.

If the volume resistivity is smaller than $1\times10^{8}\Omega\cdot$cm, electrostatic latent images can not be retained, and smeared images are liable to occur. If the resistivity is greater than $1\times10^{15}\Omega\cdot$cm, charges can not be well received from the charging member, and faulty charging is liable to occur.

The volume resistivity of the charge injection layer is measured in the following way: A charge injection layer is formed on a polyethylene terephthalate (PET) film on the surface of which a conductive layer has been formed by vacuum deposition, and its resistivity is measured using a volume resistivity measuring device (4140B pAMATER, trade name; manufactured by Hewlett Packard Co.) under application of a voltage of 100 V in an environment of 23° C./65%RH.

The charge injection layer of the present invention may include;

1) a resin layer formed of an insulating binder resin in which light-transmissive and conductive fine particles have been dispersed in an appropriate quantity;

2) an inorganic layer formed of a semiconductor or the like; and 3) an organic layer formed of a conductive polymer.

When such a charge injection layer is provided on the surface of the photosensitive member, the layer plays a role to retain the charges applied by the charging member, in a high efficiency of 90% or more. At the time of exposure, it plays a role to release the charges to the support of the photosensitive member, and can decrease residual potential.

The charge injection layer will be specifically described below.

In the case when it is the resin layer formed of conductive fine particles and a binder resin (as in the layer-1), resins such as polyester resin, polycarbonate resin, polystyrene resin, fluorine resin, cellulose, vinyl chloride resin, polyurethane resin, acrylic resin, epoxy resin, silicone resin, alkyd resin and vinyl chloride-vinyl acetate copolymer resin may be used as the binder resin. As the conductive fine particles, particles of metals such as copper, aluminum, silver and nickel, metal oxides such as zinc oxide, tin oxide, antimony oxide, titanium oxide, or solid solutions or fused solids of these, and conductive polymers such as polyacetylene, polythiophene and polypyrrole may be used. From the viewpoint of light-transmission properties of the photosensitive member, it is preferable to select and use metal oxides such as tin oxide as having a high transparency.

These conductive fine particles may preferably have particle diameters of 0.3 μm or smaller from the viewpoint of the light-transmission properties, and particularly preferably 0.1 μm or smaller. When incorporated into the charge injection layer, the conductive fine particles may preferably be in a content ranging from 2 to 280% by weight based on the weight of the binder resin, depending on their particle diameters. If they are in a content less than 2% by weight, it may become difficult to adjust the resistance of the charge injection layer. If in a content more than 280% by weight, the coating properties of the binder resin may partly lower.

Various additives may be added for the purposes of improving dispersibility of the conductive fine particles and improving their adhesion to the binder resin or improving the coat layer smoothness after the film formation. With regard to the improvement in dispersibility, it is very effective to make a surface modification of the conductive fine particles by the use of a coupling agent or a leveling agent. In view of the improvement in dispersibility, it is also effective to use a curable resin as the binder resin.

In the case when the curable resin is used in the charge injection layer, a coating solution prepared by dispersing the conductive fine particles in a solution of curable monomers or oligomers is applied to form a coating film, followed by heating or irradiation with light to cure the coating film to form a surface layer. Such a curable resin may include, for example, acrylic resins, epoxy resins, phenol resins and melamine resins. Examples are by no means limited to these. Any resins may be used so long as they are capable of curing due to chemical reaction caused by imparting light or heat energy after the coating film has been formed by coating.

The charge injection layer described above can be formed by coating a solution or dispersion containing the binder resin, the conductive fine particles and optionally some additives, on the photosensitive member, followed by drying. This layer may preferably have a thickness of from 0.1 to 10 μm, and particularly preferably from 0.5 to 5 μm.

Here, a lubricant powder may be incorporated in the charge injection layer. This decreases the friction between the photosensitive member and the charging member, or the friction between the photosensitive member and the cleaning member, so that the mechanical load applied to the electrophotographic photosensitive member can be reduced. Also, since the release properties of the photosensitive member surface is improved, developer particles (toner) can be prevented from adhering. As the lubricant particles, it is preferable to use fluorine resins, silicone resins or polyolefin resins, having a low critical surface tension. In particular, polyethylene tetrafluoride resin is preferred. In this case, the lubricant powder may be added in an amount of from 2 to 50% by weight, and more preferably from 5 to 40% by weight, based on the weight of the binder resin. If it is in an amount less than 2% by weight, its addition may not be well effective for improving the charging performance. If it is in an amount more than 50% by weight, the resolution of images and the sensitivity of the photosensitive member may be deteriorated.

In the case of the charge injection layer formed of an inorganic material (as in the layer-2), the material may include, for example, semiconductors such as amorphous silicon.

To produce the photosensitive member comprising silicon, amorphous silicon made photoconductive may be selected to form a photosensitive layer of a lower layer, and the photosensitive members can be continuously produced by high-frequency glow discharge decomposition, using a plasma-assisted CVD reactor.

In the case of the charge injection layer formed of a conductive polymer (as in the layer-3), the polymer may include, for example, electron-conjugated polymers such as polypyrrole, polythiophene and polyaniline, and organic polysilanes.

The photosensitive layer in the present invention may be of either the double-layer type having a charge generation layer and a charge transport layer or the single-layer type having a charge-generating material and a charge-transporting material in the same layer. Here, the layer thickness of the charge transport layer may preferably be set within the range of from 5 to 40 μm, and the layer thickness of the charge generation layer, from 0.05 to 5 μm.

The charge-generating material may include, for example, organic materials such as phthalocyanine pigments and azo pigments, and inorganic materials such as silicon compounds.

The charge-transporting material may include hydrazone compounds, styryl compounds, triallylamine compounds and triallylmethane compounds.

An intermediate layer may also be provided between the charge injection layer and the photosensitive layer or between the conductive support and the photosensitive layer. The intermediate layer is provided in order to improve the adhesion of the respective layers and to function as a charge barrier layer. To form the intermediate layer, it is possible to use resin materials such as epoxy resin, polyester resin, polyamide resin, polystyrene resin, acrylic resin and silicone resin.

As the conductive support for the photosensitive member, metals such as aluminum, nickel, stainless steel and steel, plastics or glasses having conductive films, and papers made conductive may be used.

The present invention will be described below in greater detail by giving Examples.

EXAMPLE 1

A plain weave sheet was produced using orange type split fibers (the number of filaments: 8; average fiber diameter: 1 μm) comprised of polyethylene terephthalate and nylon 6, and nylon 6 fibers (single fibers; fiber diameter: 30 μm). To the sheet produced, high-pressure water was jetted to open the split fibers, followed by raising with sand paper.

Next, the fiber sheet thus raised was immersed in an aqueous 15% by weight ferric chloride solution for 1 hour, and then put in a hermetically closed vessel filled with pyrrole monomers, where polymerization reaction was carried out for 2 hours to form polypyrrole on the fiber surfaces. After the reaction, the product was thoroughly washed with pure water and ethanol, followed by drying at 100° C. On the fiber sheet thus dried, its raised areas were brushed with a rigid brush to make the hair lie uniform. The raised fiber sheet thus obtained had a resistance of $5\times10^6\mu$.

The above raised fiber sheet was worked into a strip of 1 cm wide, and the strip was wound in a spiral around a mandrel of 12 mm diameter to produce a charging roller.

Here, the part cut in a strip was fixed with a urethane binder so that no hair might come off.

EXAMPLE 2

A plain weave sheet of sea-island type fibers (the number of filaments: 25; fiber diameter at the islands: 0.5 μm), the sea being comprised of polyethylene terephthalate and the islands polyethylene, was immersed in an aqueous sodium hydroxide solution to hydrolyze the sea component to generate polyethylene ultrafine fibers. Using the fibers obtained, a charging roller was produced in the same manner as in Example 1. This raised fiber sheet had a resistance of $3\times10^6\Omega$.

EXAMPLE 3

A plain weave sheet was produce d using split fibers (the number of filaments: 16; fiber diameter: 0.8 μm) comprised of polyethylene terephthalate and polypropylene, and conductive acrylic fibers (single fibers; fiber diameter: 30 μm; resistance: $1\times10^4\Omega$) having conductive carbon black dispersed therein. To the sheet produced, high-pressure water was jetted to open the split fibers, followed by raising with sand paper. The surface of the raised fiber sheet was further brushed with a rigid brush to make the hair lie uniform. The raised fiber sheet thus obtained had a resistance of $2\times10^7\Omega$.

Next, the above raised fiber sheet was wound around a conductive elastic roller of 12 mm outer diameter, comprising a metal core of 16 mm diameter made of stainless steel and provided thereon a layer of an EPDM foam (average foam cell diameter: 100 μm) having a carbon black-tin oxide mixture dispersed therein as a conducting agent. Thus, a charging roller was produced.

EXAMPLE 4

The same raised fiber sheet as in Example 1 was stuck to a blade-like stainless steel substrate (thickness: 2 mm), which was brought into contact with a photosensitive member, producing a charging blade.

EXAMPLE 5

Split fibers (the number of filaments: 8; fiber diameter: 1 μm) comprised of polyethylene terephthalate and nylon 6 was washed with dilute hydrochloric acid, and then immersed in an aqueous 20% by weight ferric chloride solution for 6 hours to allow ferric chloride to be adsorbed. This was put in a hermetically closed vessel filled with pyrrole vapor, where polymerization reaction was carried out while standing for 24 hours. After the reaction, the product was thoroughly washed with pure water and ethanol, followed by drying at 100° C.

Next, the above raised fiber sheet was worked into a plain weave sheet, and high-pressure water was jetted thereto to open the split fibers. After the opening, the product was raised using sand paper and a rigid brush. The raised fiber sheet obtained had a resistance of $1\times10^8\Omega$.

The raised fiber sheet was wound around an EPDM foam (average foam cell diameter: 100 μm; outer diameter: 12 mm; mandrel diameter: 6 mm) having conductive carbon black dispersed therein, producing a charging roller.

EXAMPLE 6

A plain weave sheet was produced by plainly weaving conductive acrylic fibers (single fibers; fiber diameter: 20 μm; resistance: $1\times10^4\Omega$) having conductive carbon black dispersed therein, in such a way that horizontal lines come in touch with each other. The plain weave sheet produced was further raised with sand paper, followed by brushing to make the hair lie uniform.

A charging roller was produced in the same manner as in Example 1 except for using the raised fiber sheet thus obtained.

COMPARATIVE EXAMPLE 1

A charging roller was produced in the same manner as in Example 1 except that the fiber sheet was made conductive in the state of neither opening nor raising.

COMPARATIVE EXAMPLE 2

The fiber sheet as used in Example 3 was made conductive in the state of neither opening nor raising, and thereafter fitted to a blade-like stainless steel substrate (the same substrate as that in Example 4) to produce a charging blade.

COMPARATIVE EXAMPLE 3

The split fibers as used in Example 3 were cut into pieces of 0.4 mm long, and the sea component was hydrolyzed in an aqueous sodium hydroxide solution. The ultrafine fibers obtained were mixed and dispersed in urethane resin in an amount of 30 parts by weight together with 30 parts by weight of conductive tin oxide. The dispersion obtained was applied by dipping on the same EPDM foam as that used in Example 5, to form a surface layer of 100 μm thick.

EVALUATION

Figure 7:
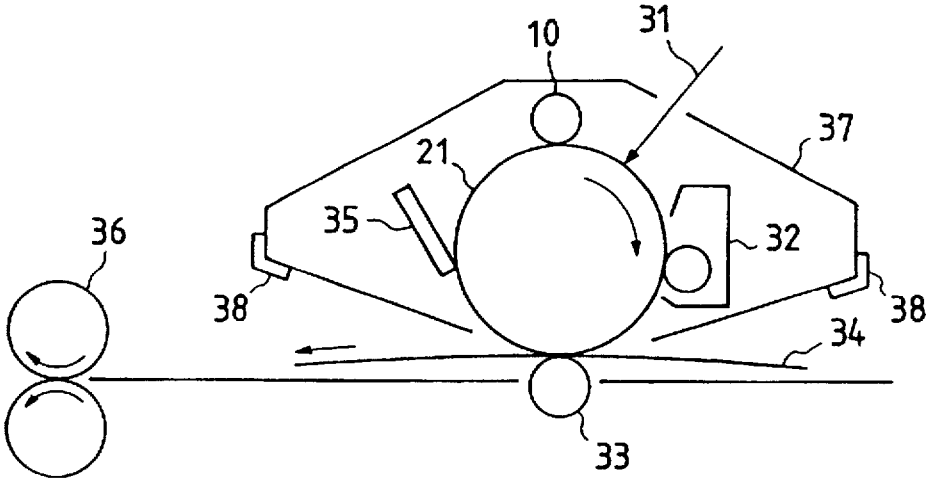
FIG. 7 illustrates the construction of the main part of a laser beam printer provided with a process cartridge having the contact charging member.

The charging roller was installed in the electrophotographic apparatus (a laser printer) shown in FIG. 7, and was brought into contact with the photosensitive member at a pressure contact load of 1 kg. The photosensitive member used did not have a charge injection layer, but a charge transporting layer as a surface layer.

The electrophotographic apparatus (a laser printer) was set to have a process speed of 16 sheets/min and a resolution of 600 dpi, and a stated voltage was applied to the charging roller rotated at a −150% opposing peripheral speed difference with respect to the rotation of the photosensitive member, where the surface scrape of the photosensitive member and the quality of images formed were examined.

With regard to the charging blade, it was fitted to a protective jig prepared by modifying the contact charging assembly exclusively used for roller fixing, and was brought into contact with the photosensitive member in a fixed state.

Images were reproduced under three kinds of environment, high temperature and high humidity H/H (32.5° C., 85%RH), normal temperature and normal humidity N/N (23° C., 60%RH), and low temperature and low humidity L/L (15° C., 10%RH).

Applied voltages were set to be AC 1.8 kVpp+DC −700 V and DC −1,200 V.

A running test was carried out on 20,000 sheets.

Image evaluation was made by measuring the whiteness of blank areas of transfer-receiving paper after and before printing by means of a reflectometer (TC-6DS, manufactured by Tokyo Denshoku K. K.), and calculating fog (%) from the difference between the two. When the fog is 5% or more, a problem arises in image quality.

Evaluation was made on the following three items.

1) Evaluation on image fog as the fog ascribable to the charging member, made at the initial stage and when images were reproduced using a charging member having been running-tested and an unused photosensitive member.

2) Evaluation on image fog as the fog ascribable to the drum scrape, made using a photosensitive member having been running-tested.

3) Evaluation on image fog, made under DC charging.

The image quality was evaluated according to four ranks, setting a border at the 5% fog (Table 1).

TABLE 1

Drum Scrape and Image Quality Evaluation Ranks

| | | |
|---|---|---|
| Image fog: | AA: | 0 to less than 2% (good image quality) |
| | A: | 2 to less than 5% |
| | B: | 5 to less than 8% |
| | C: | More than 8% (images under faulty charging) |

Evaluation Results

The results of evaluation in Examples and Comparative Examples are summarized in Table 2.

The charging members of the present invention caused no image fog ascribable to the surface scrape, exhibited uniform charging performance, and even after the running, any deterioration of image quality due to fog was not seen at all.

In the case of DC charging also, a good charging performance was seen, and the fog was not more than 5%.

On the other hand, in the case of the charging members employing the unraised fiber entangled material, the scrape of the photosensitive member could not be prevented, and also satisfactory charging performance was not obtainable, resulting in conspicuous image fog.

In the case where the ultrafine fibers were dispersed in the resin, the charging member showed a low charging performance and caused faulty charging due to the scrape of the photosensitive member.

TABLE 2

Results of Image Quality Evaluation of Examples and Comparative Examples

| Charging member | Environment | Evaluation-1)* Initial stage | Evaluation-1)* After running | Evaluation-2) After running | Evaluation-3) Initial stage |
|---|---|---|---|---|---|
| Example 1 | L/L | AA | AA | AA | AA |
| | N/N | AA | AA | AA | AA |
| | H/H | AA | AA | AA | AA |
| Example 2 | L/L | AA | AA | AA | AA |
| | N/N | AA | AA | AA | AA |
| | H/H | AA | AA | AA | AA |
| Example 3 | L/L | A | A | A | A |
| | N/N | AA | AA | AA | AA |
| | H/H | AA | AA | AA | AA |
| Example 4 | L/L | AA | AA | AA | AA |
| | N/N | AA | AA | AA | AA |
| | H/H | AA | AA | AA | AA |
| Example 5 | L/L | AA | AA | AA | AA |
| | N/N | AA | AA | AA | AA |
| | H/H | AA | AA | AA | AA |
| Example 6 | L/L | A | A | A | A |
| | N/N | A | A | A | A |
| | H/H | AA | A | A | A |
| Comparative Example 1 | L/L | B | B | B | B |
| | N/N | A | B | B | B |
| | H/H | A | B | B | B |
| Comparative Example 2 | L/L | B | B | B | C |
| | N/N | A | B | B | B |
| | H/H | A | B | C | B |
| Comparative Example 3 | L/L | B | C | C | C |
| | N/N | A | B | B | B |
| | H/H | A | B | C | B |

* Under application of AC 1.8 kVpp + DC −700 V
Evaluation-1): Fog before and after running
Evaluation-2): Fog ascribable to drum scrape
Evaluation-3): Fog under DC charging

PHOTOSENSITIVE MEMBER PRODUCTION EXAMPLE 1

First to fifth functional layers were formed on an aluminum cylinder (a support) of 30 mm diameter.

The first layer is an about 20 μm thick resin layer containing conductive particles, provided in order to level defects or the like on the aluminum drum and also to prevent moiré from being caused by the reflection of laser exposure.

The second layer is a positive-charge injection preventive layer (a subbing layer) and is a medium resistance layer of about 1 μm thick, playing a role to prevent positive charges injected from the aluminum support, from cancelling negative charges on the photosensitive member surface, and having resistivity adjusted to about $10^6\Omega$·cm by incorporating amilane resin and methoxymethylated nylon.

The third layer is a charge generation layer, and is a layer of about 0.3 μm thick, formed of a resin with a disazo pigment dispersed therein, which generates positive-negative charge pairs upon exposure to laser light.

The fourth layer is a charge transport layer, formed of polycarbonate resin with hydrazone dispersed therein, and is a p-type semiconductor layer of 20 μm thick. Hence, the negative charges on the photosensitive member surface can not move to this layer and only the positive charges generated in the charge generation layer can be transported to the photosensitive member surface.

The fifth layer is a charge injection layer, which is a layer of 3 μm thick, formed of photo-curable acrylic resin with ultrafine $SnO_2$ particles dispersed therein. Specifically, the layer is formed by coating of a dispersion containing 65% by weight of fine $SnO_2$ particles having a particle diameter of 0.03 μm, which has been doped with antimony to have a low resistivity, 30% by weight of ethylene tetrafluoride resin particles and 1.2% by weight of a dispersant, based on the resin.

Thus, the volume resistivity of the photosensitive member surface decreased to $7\times10^{12}\Omega$·cm, compared with the resistivity $3\times10^{15}\Omega$·cm in the case of the charge transport layer alone.

PHOTOSENSITIVE MEMBER PRODUCTION EXAMPLE 2

On an aluminum cylinder of 30 mm diameter having been mirror-finished, a charge blocking layer, a photoconductive layer and a surface layer (charge injection layer) were successively formed by glow discharging.

First, a reaction chamber was set to a vacuum of about $7.5\times10^{-3}$ Pa, and thereafter, while maintaining the aluminum cylinder at 250° C., $SiH_4$, $B_2H_6$, NO and $H_2$ gases were fed into the reaction chamber. In the meantime, gas was allowed to flow out of the reaction chamber to provide an internal pressure of about 30 Pa, followed by glow discharging to form a charge blocking layer of 5 μm thick.

Thereafter, by the same method as the formation of the charge blocking layer, a photoconductive layer of 20 μm thick was formed using $SiH_4$ and $H_2$ gases after the internal pressure was set to 50 Pa. Then, using $SiH_4$, $CH_4$ and $H_2$ gases, a surface layer of 0.5 μm thick was further formed by glow discharging under a pressure of 55 Pa. Thus, an amorphous silicon photosensitive member was produced.

EXAMPLES 7 to 14

Using the photosensitive members obtained in Photosensitive Member Production Examples 1 and 2, evaluation was made on the charging members obtained in Examples 1 to 6 (hereinafter "charging members 1 to 6").

As an electrophotographic apparatus, the apparatus having the same constitution as that in Examples 1 to 6 was used, except that in Examples 7 to 10, the applied voltage was changed to DC −750 V, and in Examples 11 to 14, to +500 V.

Evaluation was made on charging efficiency at the initial stage and on image fog after the running test.

The charging efficiency is expressed by (charge potential of photosensitive member/applied voltage)×100 (%). When it is 90% or more, good charging performance is obtained, and when it is 95% or more, excellent charging performance is obtained. The evaluation on fog is made according to the criteria as shown in Table 1. The tests are made in an environment of L/L (15° C., 10%RH). Results obtained are shown in Table 3.

COMPARATIVE EXAMPLES 4 and 5

Evaluation was made on charging members in the same manner as in Example 1 except for using the charging members obtained in Comparative Examples 1 and 2 (hereinafter "comparative charging members 1 and 2"). Results obtained are shown in Table 3.

TABLE 3

Results of Examples and Comparative Examples

| | Photosensitive member | Charging member | Charging efficiency | Fog |
|---|---|---|---|---|
| Example: | | | | |
| 7 | 1 | 1 | 97 | AA |
| 8 | 1 | 2 | 96 | AA |
| 9 | 1 | 3 | 95 | AA |
| 10 | 1 | 6 | 90 | A |
| 11 | 2 | 1 | 97 | AA |
| 12 | 2 | 4 | 96 | AA |
| 13 | 2 | 5 | 96 | AA |
| 14 | 2 | 6 | 91 | A |
| Comparative Example: | | | | |
| 4 | 1 | 1* | 60 | B |
| 5 | 1 | 2* | 45 | B |

*Comparative charging member

What is claimed is:

1. A charging member which is to be provided in contact with a charge-receiving member and to which a voltage is to be applied to charge the charge-receiving member, said charging member comprising:

a conductive substrate; and a surface layer which is to come in contact with said charge-receiving member; said surface layer having a raised fiber entangled material.

2. The charging member according to claim 1, wherein said raised fiber entangled material has at least one of etching fibers and split fibers.

3. The charging member according to claim 2, wherein said raised fiber entangled material has etching fibers.

4. The charging member according to claim 2, wherein said raised fiber entangled material has split fibers.

5. The charging member according to claim 1 or 2, wherein the raised fiber of said fiber entangled material have an average fiber diameter of from 0.05 μm to 30 μm.

6. The charging member according to claim 1 or 2, wherein said charge-receiving member is an electrophotographic photosensitive member.

7. The charging member according to claim 6, wherein said electrophotographic photosensitive member has a charge injection layer.

8. A process cartridge comprising an electrophotographic photosensitive member and a charging member provided in contact with said electrophotographic photosensitive member and to which a voltage is applied to charge said electrophotographic photosensitive member, or said electrophotographic photosensitive member, said charging member and a developing means or a cleaning means;

said charging member comprising a conductive substrate and a surface layer coming in contact with said electrophotographic photosensitive member; said surface layer having a raised fiber entangled material; and said electrophotographic photosensitive member and said charging member, or said electrophotographic photosensitive member, said charging member and said developing means or said cleaning means, being supported as one body on, and freely detachable from, the body of an electrophotographic apparatus.

9. The process cartridge according to claim 8, wherein said raised fiber entangled material has at least one of etching fibers and split fibers.

10. The process cartridge according to claim 9, wherein said raised fiber entangled material has etching fibers.

11. The process cartridge according to claim 9, wherein said raised fiber entangled material has split fibers.

12. The process cartridge according to claim 8 or 9, wherein the raised fiber of said fiber entangled material have an average fiber diameter of from 0.05 μm to 30 μm.

13. The process cartridge according to claim 8 or 9, wherein said electrophotographic photosensitive member has a charge injection layer.

14. An electrophotographic apparatus comprising:

an electrophotographic photosensitive member;

a charging member provided in contact with said electrophotographic photosensitive member and to which a voltage is applied to charge said electrophotographic photosensitive member;

exposure means;

developing means; and transfer means;

said charging member comprising a conductive substrate and a surface layer coming in contact with said electrophotographic photosensitive member; and said surface layer having a raised fiber entangled material.

15. The electrophotographic apparatus according to claim 14, wherein said raised fiber entangled material has at least one of etching fibers and split fibers.

16. The electrophotographic apparatus according to claim 14 or 15, wherein said raised fiber entangled material has etching fibers.

17. The electrophotographic apparatus according to claim 14 or 15, wherein said raised fiber entangled material has split fibers.

18. The electrophotographic apparatus according to claim 14 or 15, wherein the fibers of said raised fiber entangled material have an average fiber diameter of from 0.05 μm to 30 μm.

19. The electrophotographic apparatus according to claim 14 or 15, wherein said electrophotographic photosensitive member has a charge injection layer.

* * * * *

UNITED STATES PATENT AND TRADEMARK OFFICE

CERTIFICATE OF CORRECTION

PATENT NO. : 5,790,926

DATED : August 4, 1998

INVENTOR(S) : KIYOSHI MIZOE ET AL.

It is certified that error appears in the above-identified patent and that said Letters Patent is hereby corrected as shown below:

COLUMN 9

Line 37, "is" should read --are--.

Line 45, "well" should read --very--.

COLUMN 10

Line 46, "uniform." should read --uniformly.--.

Line 47, "$5x10^6\mu$." should read --$5x10^6\Omega$.--.

COLUMN 11

Line 7, "uniform." should read --uniformly.--

COLUMN 15

Line 41, "raised fiber" should read --fibers--; and "fiber" (second occurrence) should read --raised fiber--.

UNITED STATES PATENT AND TRADEMARK OFFICE

CERTIFICATE OF CORRECTION

PATENT NO. : 5,790,926

DATED : August 4, 1998

INVENTOR(S) : KIYOSHI MIZOE ET AL.

It is certified that error appears in the above-identified patent and that said Letters Patent is hereby corrected as shown below:

COLUMN 16

Line 19, "raised fiber" should read --fibers--; and "fiber" should read --raised fiber--.

Signed and Sealed this

Thirtieth Day of March, 1999

*Attest:*

*Attesting Officer*

Q. TODD DICKINSON

*Acting Commissioner of Patents and Trademarks*